United States Patent [19]

Taylor

[11] 4,044,327

[45] Aug. 23, 1977

[54] TRIMMING POTENTIOMETERS WITH COARSE AND FINE ADJUSTMENT MEANS

[75] Inventor: Derek Taylor, Whitstable, England

[73] Assignee: Bunker Ramo Corporation, Oak Brook, Ill.

[21] Appl. No.: 721,024

[22] Filed: Sept. 7, 1976

Related U.S. Application Data

[63] Continuation of Ser. No. 489,526, July 18, 1974, abandoned.

[30] Foreign Application Priority Data

Aug. 1, 1973 United Kingdom ..... 36624/73

[51] Int. Cl.[2] ..... H01C 10/32

[52] U.S. Cl. ..... 338/166; 74/10.54; 74/10.8

[58] Field of Search ..... 338/68, 118, 160, 162–174, 338/181, 184, 190–193; 74/10.54, 10.8, 10.85; 200/286; 317/255; 334/51, 57

[56] References Cited

U.S. PATENT DOCUMENTS

| | | | |
|---|---|---|---|
| 1,450,566 | 4/1923 | Smith | 317/255 X |
| 1,501,454 | 7/1924 | Hunt | 74/10.54 X |
| 1,575,153 | 3/1926 | Dobbins | 317/255 X |
| 1,805,154 | 5/1931 | Webster | 74/10.54 |
| 3,187,287 | 6/1965 | Weidenman | 338/163 |
| 3,235,827 | 2/1966 | Baker | 338/162 |
| 3,360,757 | 12/1967 | Wahlberg | 338/162 |
| 3,576,512 | 4/1971 | Michik | 338/174 |

*Primary Examiner*—Laramie E. Askin

*Attorney, Agent, or Firm*—F. M. Arbuckle; Raymond P. Niro

[57] ABSTRACT

A trimming potentiometer having a resistive member and a rotatable member attached to a wiper in contact with the resistive member for varying the position of the wiper thereon, wherein the rotatable member has a peripherally toothed portion and the non-rotatable part of the potentiometer is formed with a plurality of structures defining pivot points for a rotatable adjusting tool, each of the pivot points being spaced from the peripherally toothed portion of the rotatable member by less than the radius of this portion, whereby a toothed adjusting tool can be engaged with any one of the structures and with the toothed portion of the rotatable member for adjustment of the rotatable member by rotation of the tool, the structures being positioned to define different adjustment directions for the tool.

12 Claims, 5 Drawing Figures

TRIMMING POTENTIOMETERS WITH COARSE AND FINE ADJUSTMENT MEANS

This application is a continuation of application Ser. No. 489,526, filed July 18, 1974, now abandoned.

BACKGROUND OF THE INVENTION

1. Field of the Invention

This invention relates to trimming potentiometers of the type in which a wiper is movable over a resistive member by rotation of a rotatable member attached to the wiper.

2. Description of the Prior Art

Conventionally, the rotatable member is provided with a slot engageable by a screwdriver or a coin to enable it to be turned for adjustment of the potentiometer. However, the adjustment is relatively coarse, so that great care must be taken in adjusting the potentiometer to a precise value and for many applications the accuracy of adjustment thus obtainable is insufficient.

To overcome this disadvantage, there have been made potentiometers incorporating a worm gear engaged with teeth formed on the periphery of the rotatable member. The potentiometer is adjusted by rotation of the worm gear by a screwdriver or a key. Although a suitable velocity ratio between the worm gear and the rotatable member can be achieved so as to facilitate fine adjustments, such a design of potentiometer increases the cost considerably.

It has also been proposed to tooth the periphery of the rotatable member and to rotate this by a tool having a pinion at its end, the pinion being of smaller diameter than the rotatable member, whereby a step-down gear ratio is established. The end of the tool engages a pivot structure on the body of the potentiometer.

Neither of the known proposals deal with another problem confronting the manufacturer of trimming potentiometers, namely the requirement of users for different adjustment directions. By adjustment direction is meant the direction of presentation of the tool relative to the base plane of the potentiometer, which plane is normally defined by the terminal loads of the potentiometer. Typically, the options of adjustment from the top direction and from a side direction are required, and manufacturers supply worm gear potentiometers with the worm gear in two correspondingly different orientations relative to the terminal leads. This requires each potentiometer to be manufactured in two variants and multiplies stocking and ordering problems.

SUMMARY OF THE INVENTION

The object of the present invention is to overcome the above-enumerated problems.

According to the present invention there is provided a trimming potentiometer having a resistive member and a rotatable member attached to a wiper in contact with the resistive member for varying the position of the wiper thereon, wherein the rotatable member has a peripherally toothed portion and the non-rotatable part of the potentiometer is formed with a plurality of structures defining pivot points for a rotatable adjusting tool, each of the pivot points being spaced from the peripherally toothed portion of the rotatable member by less than the radius of this portion, whereby a toothed adjusting tool can be engaged with any one of the said structures and with the toothed portion of the rotatable member for adjustment of the rotatable member by rotation of the tool, the said structures being positioned to define different adjustment directions for the tool.

With this arrangement, by suitable choice of the number of teeth on the rotatable member and the adjusting tool, the desired velocity ratio to give fine adjustment can be obtained without the expense and complication of including an integral worm gear.

The toothed portion is conveniently of the nature of a bevel gear and may, as explained below, have a double bevel, to establish adjustment directions both perpendicular to and parallel to the axis of the rotatable member.

The said structure can be a hole or a peg adjacent to the toothed portion of the rotatable member and perpendicular to or parallel to its axis of rotation. A portion of the adjusting tool registering in the hole or on the peg locates the toothed portion of the tool in engagement with the rotatable member.

In order to enable coarse adjustments of the potentiometer to be carried out, the rotatable member may advantageously have a slot for receiving a screwdriver or such tool for rotating the rotatable member directly.

A cheap, molded tool can be given away with each order for a number of potentiometers, which can be sold for no more than the cost of simple trimmer potentiometers having only a slot for coarse adjustment thereof.

BRIEF DESCRIPTION OF THE DRAWINGS

By way of example, three embodiments of the invention will now be described with reference to the accompanying drawings, in which.

DESCRIPTION OF THE PREFERRED EMBODIMENTS

Figure 1:
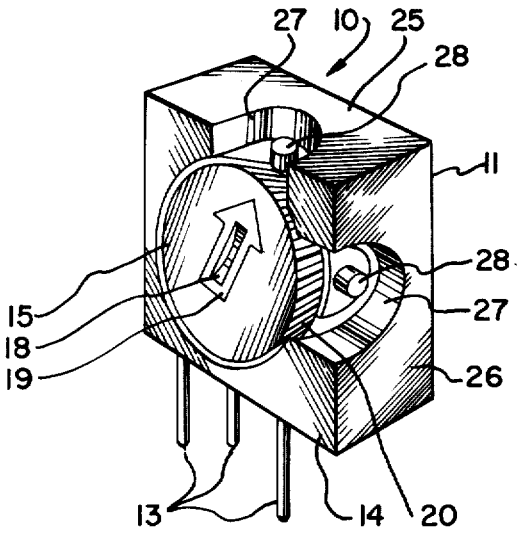
FIG. 1 is a perspective view of a trimming potentiometer constructed in accordance with the invention.

The trimming potentiometer 10 has a square prismatic body 11 of molded plastic material.

The under-surface 12 of the body 11 constitutes the base plane of the potentiometer since it is from this surface that the terminal leads 13 extend.

The front, major surface 14 of the body 11 is recessed to receive a rotatable member 15 having a spindle 16 extending into a cavity 17 within the body 11. The resistor track and wiper mechanism (not shown) of the potentiometer are disposed within the cavity 17, the wiper mechanism being attached to the spindle 16. These internal parts are not shown, as they may be entirely conventional.

The face of the member 15 has a slot 18 therein for coarse adjustment of the potentiometer by means of a screwdriver type of tool. An arrow 19 printed around the slot enables the setting of the potentiometer to be seen.

Figure 2:
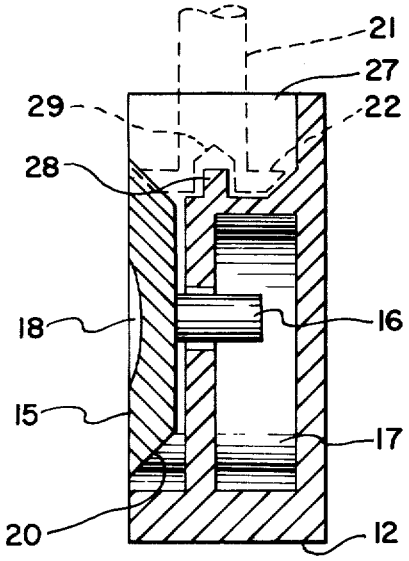
FIG. 2 is a vertical cross-section of the trimming potentiometer.

The periphery of the member 15 is bevelled towards the inside of the body 11 as indicated at 20 in FIG. 2. The bevelled surface is toothed, as is apparent from FIG. 1. Fine adjustment of the potentiometer is effected by means of the tool 21 shown in FIG. 3 which has a small bevelled pinion 22 at one end and a knurled grip 23 for turning the tool. If the bevelled pinion is engaged with the toothed bevel 20, the member 15 can be finely adjusted by rotation of the tool. The tool has a tongue 24 at the end opposite the pinion 22 for engagement in the slot 18. The one tool can thus be used for coarse and fine adjustment.

Provision is made for use of the tool 21 for fine adjustment in top and side adjustment directions. To this end, each of the top and side surfaces 25 and 26 of the body 11 has a recess 27 into which the pinion 22 can be inserted so as to mesh with the toothed bevel 20 as best seen in FIG. 2. In order to provide a pivot for rotation of the tool, a peg 28 projects from the bottom of each recess 27, and the pinion end of the tool has an axial bore 29 into which either peg will fit.

In the arrangement shown in FIG. 1, both adjustment directions are perpendicular to the axis of the rotary member 15. If it is desired to provide an adjustment direction parallel to this axis, the construction shown in FIG. 4 may be employed where the rotatable member 15 is additionally provided with a toothed front bevel 20*a*. A peg 30 projects from the front surface 14 of the body 11 and the tool 21 can be engaged on this peg, as shown by the alternative position 21*a* of the tool, to mesh the pinion 22 with the toothed front bevel 20*a*.

In a modification of either embodiment, the pegs on the body 11 are replaced by bores and a peg is formed on the pinion end of the tool. In another modification, the wall of each recess 27 is relied upon to define the pivotal position of the tool by engagement with the periphery of the pinion 22. So long as the wall of the recess extends around appreciably more than 180° of the periphery of the pinion 22, it will suffice to locate the tool and define the axis around which it is rotatable.

Figure 3:
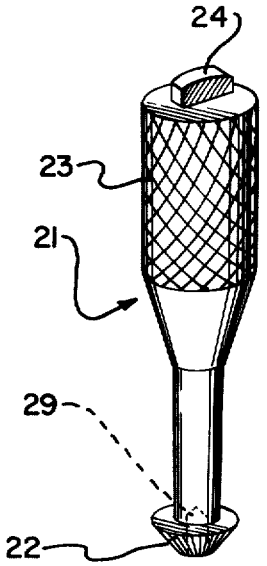
FIG. 3 is a perspective view of an adjusting tool for use with the potentiometer shown in FIGS. 1 and 2.
Figure 4:
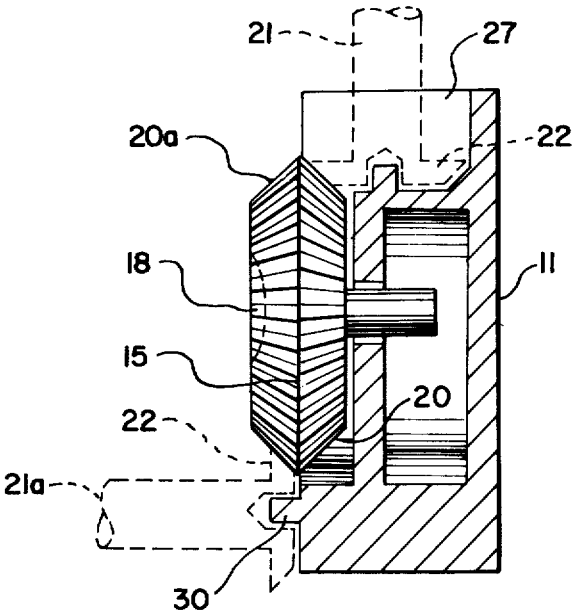
FIG. 4 is a view similar to FIG. 2 illustrating a second embodiment of the invention.
Figure 5:
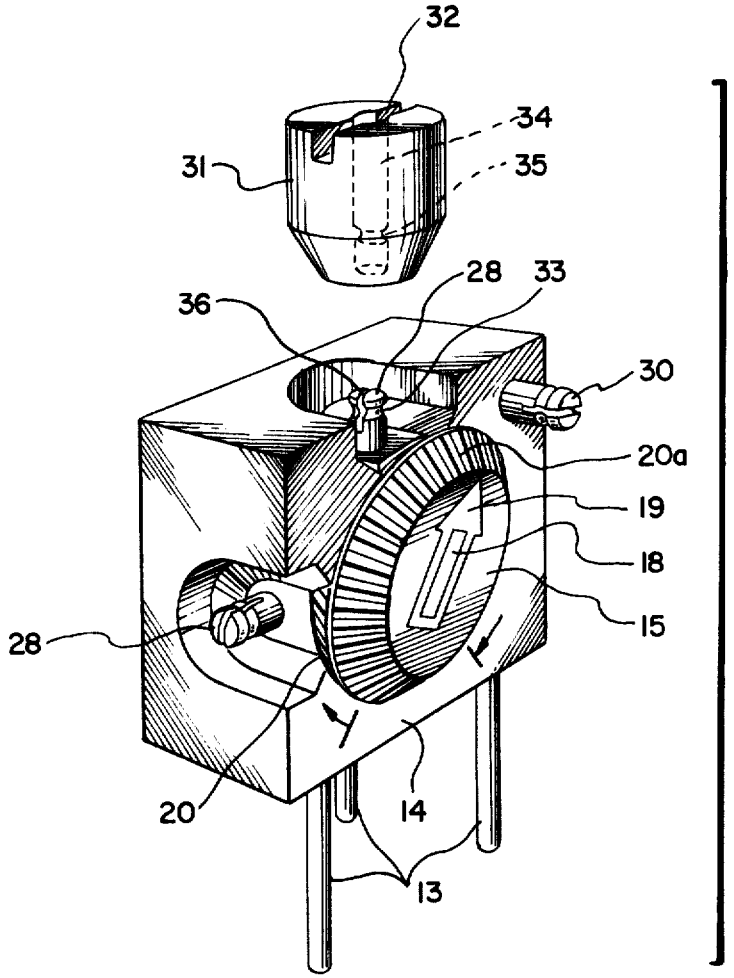
FIG. 5 is a perspective view of a third embodiment of the invention.

In the embodiment shown in FIG. 5, pegs 28 and 30 are provided as in the embodiment of FIG. 4, and the tool shown in FIG. 3 can be fitted freely on to any one of the pegs. However, each peg is now constructed in such a way that it will retain a press-fit pinion 31 formed with a screwdriver slot 32 allowing fine adjustment to be effected by means of an ordinary screwdriver. To this end each peg has an annular groove 33 and the pinion 31 has a bore 34 with an annular rib 35 which can snap into the groove 33. To allow the snap action to take place, the pegs are axially slotted at 36.

The purchaser of a potentiometer can either use the tool of FIG. 3 to effect fine adjustment from any of the three available directions or can fit a pinion 31 to any one or more of the pegs 28, 30 to allow fine adjustment to be effected by means of a screwdriver.

What I claim is:

1. A potentiometer drive having a body housing a resistive member and a rotatable member attached to a wiper in contact with said resistive member for varying the position of said wiper thereon, wherein said rotatable member has a peripherally toothed portion and said body is formed with a plurality of pivot points for a rotatable adjusting tool, each of said pivot points being spaced from said periphery toothed portion of said rotatable member by less than the radius of said rotatable member, whereby a toothed adjusting tool can be engaged with any one of said pivot points and with the toothed portion of said rotatable member for adjustment of said rotatable member by rotation of the tool, said pivot points being pegs formed on said body for rotatably fitting within a bore in the nose of an adjusting tool, and being positioned to define different adjustment directions for the tool.

2. The device as claimed in claim 1, wherein said toothed portion is in the form of a bevel gear angled to operatively mesh with an adjusting tool having a bevelled toothed nose portion.

3. The device as claimed in claim 2, wherein said bevel gear has a double bevelled edge; at least one of said pegs is adapted to receive an adjusting tool perpendicular to the axis of rotation of said rotatable member; and at least one of said pegs is adapted to receive an adjusting tool parallel to the axis of rotation of said rotatable member; whereby tool adjusting positions are established in directions both perpendicular to and parallel to the axis of said rotatable member.

4. The device as claimed in claim 1, including at least one press-fit pinion engaging one of said pegs with a snap fit, said pinion having a toothed edge mating with said toothed portion of said rotatable member and having a screwdriver slot therein.

5. The device as claimed in claim 4, wherein said pegs are slotted pegs formed on said body and having an annular groove formed therein, and wherein said pinion is provided with a bore having an annular rib intermediate the ends of said bore mating with said peg in an interference fit but with said annular groove in freely rotatable fit.

6. A potentiometer drive having a body housing a resistive member and a rotatable member attached to a wiper in contact with said resistive member for varying the position of said wiper thereon, wherein said rotatable member has a peripherally toothed portion and said body is formed with a plurality of pivot points for a rotatable adjusting device whereby a toothed adjusting device can be engaged with any one of said pivot points and with the toothed portion of said rotatable member for adjustment of said rotatable member by rotation of the device, said drive including at least one press-fit pinion engaging one of said pivot points with a snapfit, said pinion having a toothed edge mating with said toothed portion of said rotatable member.

7. The device as claimed in claim 6, wherein said pivot points are slotted pegs formed on said body and having an annular groove formed therein, and wherein said pinion is provided with a bore having an annular rib intermediate the ends of said bore mating with said peg in an interference fit but with said annular groove in freely rotatable fit.

8. A potentiometer drive having a body housing a resistive member and a rotatable member attached to a wiper in contact with said resistive member for varying the position of said wiper thereon, wherein said rotatable member has a peripherally toothed portion and said body is formed with a plurality of pivot points for a rotatable adjusting tool, each of said pivot points being spaced from said peripherally toothed portion of said rotatable member by less than the radius of said rotatable member, whereby a toothed adjusting tool can be engaged with any one of said pivot points and with the toothed portion of said rotatable member for adjustment of said rotatable member by rotation of the tool, at least one of said pivot points including a recess formed in said body for rotatably receiving and mating with the outer periphery of said rotatable adjusting tool, wherein said recess is cylindrically shaped and encompasses greater than 180° of the circumference of said rotatable adjusting tool, said recess thereby constituting said at least one pivot point.

9. The potentiometer drive of claim 8 wherein said recess includes a bore for rotatably receiving a peg extending from said rotatable adjusting tool.

10. A trimming potentiometer capable of both coarse and fine adjustment comprising:

a body member;

a resistive member and wiper disposed within said body, said wiper being in contact with and movable over said resistive member;

a rotatable member attached to said wiper and pivoted on said body member for varying the position of said wiper on said resistive member, said rotatable member including double bevelled edge portions containing a plurality of teeth spaced about the periphery of said rotatable member;

a recess formed in said rotatable member for receiving an adjusting device capable of making coarse adjustment of said potentiometer through rotation of said rotatable member; and at least two pivot points formed on said body for receiving a rotatable toothed adjusting device, whereby said toothed adjusting device can be simultaneously engaged with any one of said pivot points and the teeth on said rotatable member for fine adjustment of said potentiometer through rotation of said rotatable device, at least one of said pivot points being disposed to receive said toothed adjusting device perpendicular to the axis of rotation of said rotatable member, and at least one of said pivot points being disposed to receive said toothed adjusting device parallel to the axis of rotation of said rotatable member.

11. The potentiometer as claimed in claim 10 wherein said pivot points are pegs formed on said body member for rotatably fitting within a pin recess formed in said toothed adjusting device.

12. The potentiometer as claimed in claim 10 wherein said pivot points are recesses formed in said body member for rotatably receiving a peg extending from said toothed adjusting device.

* * * * *